US011231250B1

(12) United States Patent
Fisher

(10) Patent No.: US 11,231,250 B1
(45) Date of Patent: Jan. 25, 2022

(54) HANDHELD DEFENSE AND DETERRENCE DEVICE

(71) Applicant: Jodi Sheryl Fisher, Tucson, AZ (US)

(72) Inventor: Jodi Sheryl Fisher, Tucson, AZ (US)

( * ) Notice: Subject to any disclaimer, the term of this patent is extended or adjusted under 35 U.S.C. 154(b) by 0 days.

(21) Appl. No.: 16/787,873

(22) Filed: Feb. 11, 2020

Related U.S. Application Data

(60) Provisional application No. 62/807,119, filed on Feb. 18, 2019.

(51) Int. Cl.

| | |
|---|---|
| ***F41B 15/00*** | (2006.01) |
| ***F41B 13/08*** | (2006.01) |
| ***F41H 9/10*** | (2006.01) |
| ***F41H 13/00*** | (2006.01) |
| ***F41H 9/04*** | (2006.01) |

(52) U.S. Cl.
CPC ..... *F41B 13/08* (2013.01); *F41H 9/04* (2013.01); *F41H 9/10* (2013.01); *F41H 13/0018* (2013.01); *F41H 13/0087* (2013.01)

(58) Field of Classification Search
CPC ... F41B 13/08; F41H 9/04; F41H 9/10; F41H 13/0018; F41H 13/0087
See application file for complete search history.

(56) References Cited

U.S. PATENT DOCUMENTS

| | | | | |
|---|---|---|---|---|
| 78,887 | A | 6/1868 | Morse et al. | 30/348 |
| 197,857 | A | 12/1877 | Jameson | 30/298 |
| 203,978 | A | 5/1878 | Woods | 2/21 |
| 288,096 | A | 11/1883 | Morgan | 30/32 |
| 421,665 | A | 2/1890 | Buchman | 2/21 |
| 488,945 | A | 12/1892 | Nelson | 30/298 |
| 519,999 | A | 5/1894 | Godbey | 30/232 |
| 784,421 | A | 3/1905 | Painter | 30/291 |
| 814,080 | A | 3/1906 | Reed | 30/298 |
| 824,925 | A | 7/1906 | Gosnell | 30/162 |
| 864,812 | A | 9/1907 | Thuillier | 30/348 |
| 885,569 | A | 4/1908 | Bergquist | 294/25 |
| 1,300,521 | A | 4/1919 | Villiger | 30/291 |
| 1,324,672 | A | 12/1919 | Hempel | 30/162 |

(Continued)

FOREIGN PATENT DOCUMENTS

| | | | |
|---|---|---|---|
| CA | 2125721 | 12/1995 | B26B 27/007 |
| CH | 149157 | 8/1931 | B26B 27/007 |

(Continued)

OTHER PUBLICATIONS

"Sabre Red Pepper Gel Spray for Runners—Gel is Safer—Maximum Police Strength OC Spray, Adjustable Hand Strap for Quick Access while Running—Optional Clip-on 120dB Personal Alarm w/LED Light" Amazon page, accessed Feb. 13, 2020, 11 pages.

(Continued)

*Primary Examiner* — William M Pierce

(57) ABSTRACT

A self-defense system includes a first sleeve retainably securing a deterrent item. A second sleeve is laterally coupled to the first sleeve and houses a knife. The knife has a handle and a tip. A closed portion of the second sleeve houses the knife handle. An open portion of the second sleeve flexibly covers the knife tip. A hand strap is laterally adjacent to the second sleeve and coupled to at least one of: the first sleeve and the second sleeve. The hand strap is sized and shaped to secure the self-defense system about a hand of a user.

19 Claims, 7 Drawing Sheets

(56) References Cited

U.S. PATENT DOCUMENTS

| | | | | | |
|---|---|---|---|---|---|
| 1,365,952 | A | | 1/1921 | Raymer | 30/161 |
| 1,482,647 | A | * | 2/1924 | Gise | A45F 5/00 24/3.2 |
| 1,536,752 | A | | 5/1925 | Franklin | 30/291 |
| 1,599,126 | A | | 9/1926 | Freeman | 30/291 |
| 1,643,336 | A | | 9/1927 | Frost | 15/236.07 |
| 2,533,105 | A | | 12/1950 | Groff | 30/298 |
| 2,555,735 | A | | 6/1951 | Eastabrooks | 30/355 |
| 2,989,807 | A | | 8/1961 | Florence | 30/151 |
| D205,456 | S | | 8/1966 | Combs | |
| 3,457,643 | A | | 7/1969 | Hill | 30/293 |
| 3,587,591 | A | | 6/1971 | Satterwhite | 30/298 |
| 4,463,879 | A | * | 8/1984 | Des Voignes | F41H 9/10 222/175 |
| 4,600,133 | A | * | 7/1986 | Maihos | B26B 29/025 224/232 |
| 4,797,974 | A | | 1/1989 | Smith | 294/25 |
| 4,835,865 | A | * | 6/1989 | Knoop | B26B 5/003 30/162 |
| 4,848,000 | A | * | 7/1989 | O'Dell | B26B 29/025 30/158 |
| 5,009,347 | A | * | 4/1991 | Phelps | A45C 1/04 224/219 |
| 5,127,891 | A | * | 7/1992 | Winston | A63B 21/065 482/105 |
| 5,263,838 | A | * | 11/1993 | Meuser | A01M 31/004 206/315.11 |
| 5,301,432 | A | | 4/1994 | Richardson | 30/291 |
| 5,325,997 | A | * | 7/1994 | Washington | F41H 9/10 222/175 |
| 5,337,933 | A | * | 8/1994 | Nunez | A01K 97/06 224/581 |
| D354,663 | S | | 1/1995 | Clark et al. | |
| 5,443,192 | A | * | 8/1995 | Hodges | A45F 5/021 224/148.6 |
| D369,453 | S | * | 5/1996 | Robbins | D22/117 |
| 5,588,214 | A | | 12/1996 | Nelson | 30/368 |
| 5,961,003 | A | * | 10/1999 | Coryell | F41H 9/10 222/175 |
| 6,123,228 | A | | 9/2000 | Hippensteel | 222/78 |
| 6,126,040 | A | | 10/2000 | Hippensteel | 222/78 |
| 6,135,321 | A | | 10/2000 | Hippensteel | 222/78 |
| 6,378,745 | B1 | * | 4/2002 | De Luccia | A45F 5/00 224/218 |
| 7,036,262 | B2 | | 5/2006 | Yabusaki | 294/25 |
| D811,515 | S | | 2/2018 | Parise | |
| 10,016,051 | B2 | * | 7/2018 | Hintze | B25H 3/00 |
| D829,298 | S | | 9/2018 | Parise | |
| D841,761 | S | | 2/2019 | Lin | |
| D849,875 | S | | 5/2019 | Dopps | |
| 10,520,277 | B1 | | 12/2019 | Parise | |
| D890,878 | S | | 7/2020 | Rae | |
| D892,967 | S | | 8/2020 | Pala | |
| D924,649 | S | | 7/2021 | Chumchal | |
| D925,308 | S | | 7/2021 | Chumchal | |
| 2004/0055917 | A1 | * | 3/2004 | Stern | B25H 3/003 206/373 |
| 2004/0244119 | A1 | * | 12/2004 | Terzuola | B26B 29/025 7/158 |
| 2005/0193565 | A1 | | 9/2005 | Knowles | 30/155 |
| 2008/0223892 | A1 | * | 9/2008 | Hamilton | A45F 5/00 224/587 |
| 2010/0139048 | A1 | * | 6/2010 | Pesic | A45F 5/00 24/3.2 |
| 2010/0251552 | A1 | | 10/2010 | Gazcon et al. | 30/162 |
| 2011/0132929 | A1 | * | 6/2011 | Bennett | B65D 83/206 222/113 |
| 2012/0192434 | A1 | | 8/2012 | Syrjala | 30/162 |
| 2012/0304471 | A1 | | 12/2012 | Jones | 30/162 |
| 2014/0208594 | A1 | | 7/2014 | Scimone | 30/2 |
| 2014/0259694 | A1 | | 9/2014 | Oldham | 30/298 |
| 2015/0014382 | A1 | * | 1/2015 | Hintze | B25H 3/00 224/661 |
| 2015/0075013 | A1 | | 3/2015 | Novak | 30/348 |
| 2015/0283717 | A1 | * | 10/2015 | Hong | A22C 25/006 30/146 |
| 2020/0128944 | A1 | * | 4/2020 | Martinez-Rodriguez | B25H 3/003 |
| 2020/0248982 | A1 | | 8/2020 | Trussell | F41B 15/06 |

FOREIGN PATENT DOCUMENTS

| | | | |
|---|---|---|---|
| CH | 375249 | 2/1964 | B26B 27/007 |
| DE | 29620070 | 2/1997 | A44C 9/00 |

OTHER PUBLICATIONS

Office Action issued in U.S. Appl. No. 14/678,926 dated Oct. 6, 2016 (12 pgs).

Office Action issued in U.S. Appl. No. 14/678,926 dated Jan. 30, 2020 (13 pgs).

Office Action issued in U.S. Appl. No. 14/678,926 dated Apr. 30, 2020 (13 pgs).

Notice of Allowance issued in U.S. Appl. No. 14/678,926 dated Aug. 6, 2020 (9 pgs).

U.S. Appl. No. 29/49,679, filed Sep. 8, 2020, Fisher.

"KSK Self-Defense Key Chain", at https://www.amazon.com/dp/B08NVFKVL6/ref=redir_mobile_desktop?_encoding=UTF8&aaxitk=e87de377a90b696257d39afced376fc3&hsa_cr_id=6899489930801&pd_rd_plhdr=t&pd_rd_r=9fab4054-7769-4aaf-8e0d-dbfa7177021b&pd_rd_w=LCxsW&pd_rd_wg=Fbflh&ref=sbx_be_s_sparkle_mcd_asin_0_img&th=1, 2020, 1 pg.

Notice of allowance issued in U.S. Appl. No. 29/749,679, dated Nov. 10, 2021, 8 pgs.

* cited by examiner

Method of Making a Self-Defense System

600

HANDHELD DEFENSE AND DETERRENCE DEVICE

CROSS REFERENCE TO RELATED APPLICATION

This application claims benefit of U.S. Provisional Application Ser. No. 62/807,119 filed Feb. 18, 2019 and titled "A Self-Defense Device," the entire disclosure of which is incorporated herein by reference.

FIELD OF THE DISCLOSURE

The present disclosure is generally related to self-defense devices and more particularly is related to handheld self-defense and deterrence devices.

BACKGROUND OF THE DISCLOSURE

Personal safety is an important consideration for vulnerable persons. Certain activities, such as those performed alone, during early or late hours, or in dangerous areas, give rise to a need for protection. Certain groups, such as women, children, and isolated individuals, may find themselves particularly in need of protection from other people who may seek to attack them. Numerous methods and devices exist for self-defense, including weapons, defensive sprays, alarms, and defense training. However, these devices and methods can be ineffective under several circumstances.

In particular, societal norms and practical necessity dictate that most self-defense devices must be stored. It is generally considered inappropriate for someone to carry a firearm or other weapon in their hands while doing an otherwise innocuous activity. It may also be dangerous to brandish a weapon, as it increases the likelihood of accidental use. Therefore, it is commonly known to store self-defense devices in a pocket, purse, bag, vehicle, and the like. This, however, increases the response time required for a person to locate, prepare, and use the self-defense device. Consequently, in the event of an attack, a person storing a self-defense device will be slow to respond. In some cases, it may be impossible for the person to brandish the self-defense device in time to stop the attack. Additionally, in many activities where a self-defense device would be useful, such as hiking, jogging, or walking, it is not convenient to store such a device in the conventional ways. For example, many joggers wear clothing without pockets and do not bring along bags or other storage devices. Therefore, it can be difficult to accommodate a self-defense device without encountering the above-mentioned challenges.

Further still, most self-defense devices and methods do not provide multiple points of protection. For example, a knife or bladed device may provide defense from an attacker at close range, but cannot deter an attack from a distance. Likewise, an alarm may deter an attacker from a distance, but may provide little practical defense at close range.

Thus, a heretofore unaddressed need exists in the industry to address the aforementioned deficiencies and inadequacies.

SUMMARY OF THE DISCLOSURE

Embodiments of the present disclosure provide a self-defense system. Briefly described, in architecture, one embodiment of the system, among others, can be implemented as follows. A self-defense system includes a first sleeve retainably securing a deterrent item. A second sleeve is laterally coupled to the first sleeve and houses a knife. The knife has a handle and a tip. A closed portion of the second sleeve houses the knife handle. An open portion of the second sleeve flexibly covers the knife tip. A hand strap is laterally adjacent to the second sleeve and coupled to at least one of: the first sleeve and the second sleeve. The hand strap is sized and shaped to secure the self-defense system about a hand of a user.

The present disclosure can also be viewed as providing methods of making a self-defense system. In this regard, one embodiment of such a method, among others, can be broadly summarized by the following steps: retainably securing a deterrent item within a first sleeve; housing a knife within a second sleeve laterally coupled to the first sleeve, the knife having a handle and a tip, wherein a closed portion of the second sleeve houses the knife handle, and wherein an open portion of the second sleeve flexibly covers the knife tip; and coupling a hand strap to at least one of: the first sleeve and the second sleeve, the hand strap sized and shaped to secure the self-defense system about a hand of a user.

The present disclosure can also be viewed as providing a self-defense device holder. Briefly described, in architecture, one embodiment of the holder, among others, can be implemented as follows. A self-defense device holder includes a first sleeve sized and shaped to retainably secure a deterrent item. A second sleeve is laterally coupled to the first sleeve. The second sleeve has a closed portion and an open portion. The closed portion is sized and shaped to house at least a portion of a knife handle. The open portion is shaped to flexibly cover a knife tip. A hand strap is laterally adjacent to the second sleeve and coupled to at least one of: the first sleeve and the second sleeve. The hand strap is sized and shaped to secure the self-defense device holder about a hand of a user.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

FIGS. 1A-1D are side view illustrations of a self-defense system 100, in accordance with a first exemplary embodiment of the present disclosure. The self-defense system may be described herein by terms of various functional system elements and/or various method steps.

Such functional elements may be realized by any number of hardware components to perform specified functions and achieve various results. For example, the self-defense system may employ and/or engage various blades, sheathes, sleeves, straps, fittings, supports, and the like, which may carry out a variety of functions. In addition, the self-defense system may be practiced in conjunction with any variety of self-defense applications, whether traveling, commuting, exercising, for sports, etc., and any systems described are merely exemplary applications. The self-defense system may be used in conjunction with various items of interest a user may desire to have readily available, such as pepper spray, flashlights, an alarming signal, etc. Further, the self-defense system may employ any number of conventional techniques for manufacturing, packaging, marketing, distributing, and/or selling the self-defense system.

Figure 1A:
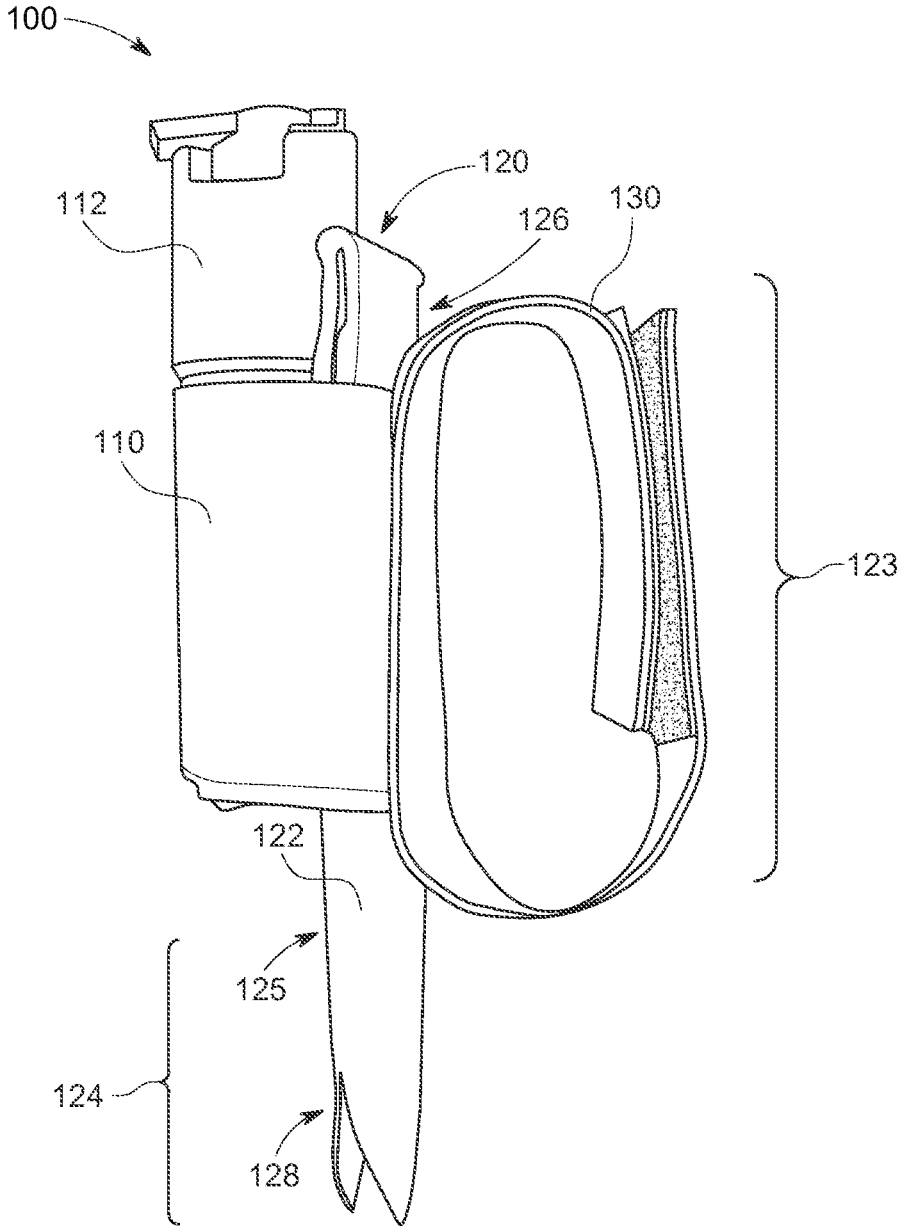
FIGS. 1A-1D are side view illustrations of a self-defense system, in accordance with a first exemplary embodiment of the present disclosure.

FIG. 1A shows a self-defense system 100 having a pepper spray deterrent item 112. The self-defense system 100 includes a first sleeve 110 retainably securing a deterrent item 112. A second sleeve 120 is laterally coupled to the first sleeve 110 and houses a knife 122. The knife 122 has a handle 123 and a tip 124. A closed portion 126 of the second sleeve 120 houses the knife handle 123. An open portion 128 of the second sleeve 120 flexibly covers the knife tip 124. A hand strap 130 is laterally adjacent to the second sleeve 120 and coupled to at least one of: the first sleeve 110 and the second sleeve 120. The hand strap 130 is sized and shaped to secure the self-defense system about a hand of a user.

The first sleeve 110 may be a sleeve at least partially surrounding a deterrent item 112. In one example, the first sleeve 110 may surround at least a lateral portion of the deterrent item 112. In another example, the first sleeve 110 may surround a top or bottom portion of the deterrent item 112. The first sleeve 110 retainably secures the deterrent item 112. In one example, the first sleeve 110 may be expandable to secure the deterrent item 112. The first sleeve 110 may be made from an elastic material, such as stretchable cloth, textile, plastic, rubber, polymer, elastic, or any combination thereof. At least a portion of the first sleeve 110 may expand to secure the deterrent item 112. For instance, an exterior portion of the first sleeve 110 may expand to secure the deterrent item 112, while another portion affixed to the second sleeve 120 does not expand. In another example, a bottom portion of the first sleeve 110 may expand to secure the deterrent item 112 while the remaining portion does not expand. In still another example, the entire first sleeve 110 may expand. In one example, the first sleeve 110 may have a shape similar to a deterrent item 112 in order to more firmly secure the deterrent item 112. For instance, if the deterrent item 112 has a rectangular shape, the first sleeve 110 may have a similar rectangular shape. If the deterrent item 112 has a cylindrical shape, the first sleeve 110 may have a cylindrical shape. Where the first sleeve 110 is expandable, the first sleeve 112 may have a similar shape to the deterrent item 112 when in an expanded state.

The deterrent item 112 may be an item that deters attacks from a distance or at close range. For example, deterrent items 112 may include pepper spray, lights, stun devices, and signaling alarms. Pepper spray may include any type of sprayable deterrent, such as any type of capsaicin spray, tear gas, mace or other gas, liquid spray, powder, or other substance that is capable of injuring, immobilizing, or otherwise incapacitating a person. Lights may include any suitable light source, including LED, OLED, diode, compact fluorescent, incandescent, and the like. Lights may also include combustible or chemical reaction sources, such as signal flares and the like. In one example, the light may be used to illuminate a portion of the user's area, as a flashlight or floodlight. In another example, the light may be used to draw attention to the user, such as a signal flare or a reflective signal. In yet another example, the light may be used to stun or disorient an attacker, such as a stun device or flash light. In another example, the light may be used to blind or incapacitate an attacker, such as a class IV laser source capable of damaging vision. Stun devices may be any type of electroshock devices capable of delivering an electrical charge to a target. Stun devices may include stun guns, which deliver electrical charge upon contact, tasers, which deliver electrical charge via projected electrical contact, and electroshock projectiles fired from a device. Signaling alarms may include any type of devices that emit audible or visual alarms. For instance, a signaling alarm may include an audible alarm that may be used to alert others to the user or disorient an attacker. A signaling alarm may combine an audible signal with a light as described above to alert or disorient. The deterrent item 112 may also include a networked call device capable of transmitting a distress signal over a wireless network, such as a cellular, Wi-Fi, satellite, or other network. The distress signal may alert authorities as to the presence and location of a user in distress.

The deterrent item 112 may be retainably secured within the first sleeve 110. In one example, at least a portion of the deterrent item 112 may be surrounded or housed by the first sleeve 110. Where the first sleeve 110 is expandable, a portion of the deterrent item 112 may be biasably held by the first sleeve 110. However, other forms of retaining are considered to be within the scope of this disclosure. The first sleeve 110 may retain the deterrent item 112 by use of locking mechanisms, fasteners, clasps, adhesive, and the like. Locking mechanisms may include mechanical locks, electronic locks, and the like. Fasteners may include pins, nails, screws, staples, bolts, and the like. Clasps may include biased mechanical elements. Adhesives may include glues, epoxies, resins, and the like. The deterrent item 112 may be retainably secured by any suitable means.

In one example, the deterrent item 112 may be removable from the first sleeve 110. For example, a pepper spray deterrent item 112 may be removable from the first sleeve 110 by removing the canister from the sleeve 110. Empty or damaged canisters may be replaced by new, functional canisters by inserting the new canisters into the first sleeve 110. In one example, the type of deterrent item 112 within the first sleeve 110 may be changed depending on the user's preference or environment. For instance, the user may initially prefer to use a pepper spray deterrent item 112 when jogging in a particular area. The user may prefer to use a light deterrent item when jogging at night. The user may swap any deterrent item 112 for any other deterrent item 112 as desired. The replaceability of the deterrent item 112 may allow the system 100 to provide deterrence and defense in a number of variable situations.

The deterrent item 112 may be operable while retainably secured within the first sleeve 110. For example, a user may not need to undo a clasp or button, open a lock securing the deterrent item 112, or otherwise disengage any securing mechanism in order to operate the deterrent item 112. This may allow the user to operate the deterrent item 112 without undue delay caused by disengaging a securing mechanism. In essence, the deterrent item 112 may always be ready to use when secured within the first sleeve 110.

FIG. 1A shows a pepper spray deterrent item 112. The pepper spray is sized and shaped to fit within a user's hand, and may be held within the system 100 while the user is performing an activity. The first sleeve 110 is shown securing the pepper spray deterrent item 112 about a lateral size and a bottom side of the deterrent item 112. A locking portion of the pepper spray is oriented to be accessible to a user's thumb or other fingers. The pepper spray may remain in a locked position until the user disengages the locking portion to prepare the pepper spray to fire. When in the user's hand, the pepper spray deterrent item 112 may be operable with a closed fist. The nozzle of the pepper spray may extend above the first sleeve 110 to be operable while the pepper spray deterrent item 112 is retained within the first sleeve 110. The orientation of the pepper spray deterrent item 112 may be rotatable to approximately align a stream of the pepper spray along an axis of a user's arm. This may allow the user to control the aiming accuracy of the pepper spray.

A second sleeve 120 may be laterally coupled to the first sleeve 110. In one example, the second sleeve 120 may be coupled to an interior of the first sleeve 110. For instance, as shown in FIG. 1A, the second sleeve 120 is coupled to the first sleeve 110 by a portion of the first sleeve 110 wrapping about an exterior of the second sleeve 120. In another example, the second sleeve 120 may be coupled to an exterior of the first sleeve 110. In another example, the first and second sleeves 110, 120 may be formed as a unitary, monolithic piece. The first and second sleeves 110, 120 may be coupled by any suitable means or methods. For instance, the first and second sleeves 110, 120 may be sewn together, affixed using an adhesive material, heat pressed, or secured using a fastener such as staples, rivets, and the like. Any combination of materials and methods may be used.

The second sleeve 120 may be made from any suitable material, including cloth, textile, synthetic materials such as polyester, nylon, acrylic, rayon, and microfiber, leather, rubber, polymer, and the like. In one example, the second sleeve 120 may be made from a plurality of materials. For instance, a closed portion 126 of the second sleeve 120 may be made from a first material, such as leather or synthetic material, while an open portion 128 of the second sleeve 120 may be made from a second material, such as a rubber or polymer. This may allow the closed portion 126 to have a pleasant or resilient housing for use in a hand, while the open portion 128 may have a flexible housing for easy use in operation. The plurality of materials may be joined by any suitable process.

The second sleeve 120 may be oriented along an elongate axis. In one example, the first and second sleeves 110, 120 may be oriented substantially along the same elongate axis. When in use with a user's hand, this elongate axis may be substantially orthogonal to the user's arm. This may allow the deterrent item 112 to be operated along the axis of the user's arm, while the knife 122 may be operated orthogonal to the user's arm. These relative directions of operation may improve the accuracy and efficacy of the deterrent item 112 and knife 122 when used to defend and deter and attacker.

The second sleeve 120 may include a closed portion 126 and an open portion 128. The closed portion 126 may be a portion of the second sleeve 120 that at least partially encloses the knife 122. In one example, at least a portion of the knife handle (shown in FIG. 3, below) may be enclosed by the closed portion 126. The closed portion 126 may be sized and shaped to fit about the exterior of the knife handle. In one example, the closed portion 126 may be the same relative shape as the knife handle, and larger to enclose the exterior. In another example, the closed portion 126 may have an interior shaped to accommodate the knife handle, while the exterior may be shaped to fit comfortably within a user's hand. For instance, the exterior may be ergonomically shaped to resemble the curves and ridges of a closed hand. This may improve the user's grip and may make the system 100 easier to carry over the course of a long period of time.

The closed portion 126 may be closed about at least a portion of the second sleeve. In one example, at least a portion of an exterior edge 125 of the second sleeve 120 may be enclosed. The exterior edge 125 may extend vertically along the elongate axis of the second sleeve 120 and horizontally along the top of the second sleeve 120. Any suitable means may be used to enclose the knife 122 within the closed portion 126. This may include sewing or otherwise fastening opposing sides together, bonding by heat or epoxy, weaving together, or utilizing a single piece of material as the closed portion 126. In one example, the enclosure may not be continuous, but may only exist at key points along the closed portion 126. In another example, the enclosure may be at least substantially continuous along the exterior edge 125. The closed portion may extend at least substantially along the knife handle, and may end about where the knife tip begins.

The open portion 128 may begin where the closed portion 126 ends, and may flexibly cover the knife tip. In one example, the open portion 128 may be made from the same piece of material as the closed portion 126. The open portion 128 may have the same approximate shape as the knife tip and may be sized to be at least a little larger in order to cover the knife tip. At least a portion of the open portion 128 may be flexible to uncover the knife tip. In one example, one or more sides of the open portion 128 may be peeled away from the knife tip. In another example, a stabbing or jamming motion of the knife 122 may cause the sides of the open portion 128 to be peeled away. The open portion 128 is discussed in greater detail in FIG. 4, below.

In one example, the knife 122 may be removable from the second sleeve 120. For instance, one or more fasteners, clasps, or other securing mechanisms may be removed or undone. This may allow the knife 122 to be pulled from the second sleeve 120 as a sheath. In one example, the knife 122 may be replaced back into the second sleeve 120.

FIG. 1A shows a self-defense system 100 having a knife 122 housed within the second sleeve 120. The knife 122 is shown in greater detail in FIG. 3, below.

A hand strap 130 may be included. The hand strap 130 may be any suitable shape and size for securing the self-defense system 100 to the hand of a user. In one example, the hand strap 130 may generally have a loop shape to secure the device between the user's palm and the back of the hand. The hand strap 130 may have an elongate axis substantially parallel to the first and second sleeves 110, 120, i.e., an oval shape wherein the longer diameter runs along the elongate axis of the first and second sleeves 110, 120. In one example, the system 100 may include a plurality of hand straps 130 that may secure the system 100 to the user's hand at a plurality of points.

A hand strap 130 may be laterally adjacent to the second sleeve 120. In one example, the hand strap 130 may be located on a side of the second sleeve 120 opposite the first sleeve 110. Thus, the placement of the constituent items within the system 100 may be as follows: the deterrent item 112 is adjacent to the knife 122, and the knife is adjacent to the hand strap 130. In use, this may cause the position of the knife 122 to be against the palm of the user's hand, rather than the fingers, which may improve stability when the knife 122 is used against an attacker. This may also cause the position of the deterrent item 112 to be against the user's fingers (when the hand is closed), which may be more accessible to the user's thumb. This may allow the user to operate the deterrent item 112 more readily.

The hand strap 130 may be made from any suitable material, including the materials discussed relative to the first and second sleeves 110, 120, above. In one example, the hand strap 130 may be expandable, as in the case of an elastic or rubber material. In another example, the hand strap 130 may be a continuous piece, such as a loop. A user may put on the system 100 by stretching the hand strap over their hand until it is secure. In another example, the hand strap 130 may include separate ends that are removably fastenable together. This is discussed in detail in FIG. 2, below.

The hand strap 130 may be coupled to the first sleeve 110, the second sleeve 120, or any combination thereof. For example, the hand strap 130 may be directly coupled to the second sleeve 120 using any of the coupling methods and materials described above. When the second sleeve 120 is located on the interior of the first sleeve 110, as shown in FIG. 1A, the hand strap 130 may be coupled to the first sleeve 110 where it contacts the first sleeve 110. In another example, the hand strap 130 may be coupled to the first and second sleeves 110, 120.

In one example, hand strap 130 may be sized and shaped as a glove capable of fitting the user's hand. For instance, the palm of the glove may be coupled to the first or second sleeves 110, 120, or any combination thereof. The user may put on the glove as is commonly known and wear it while performing a desired activity.

Figure 1B:
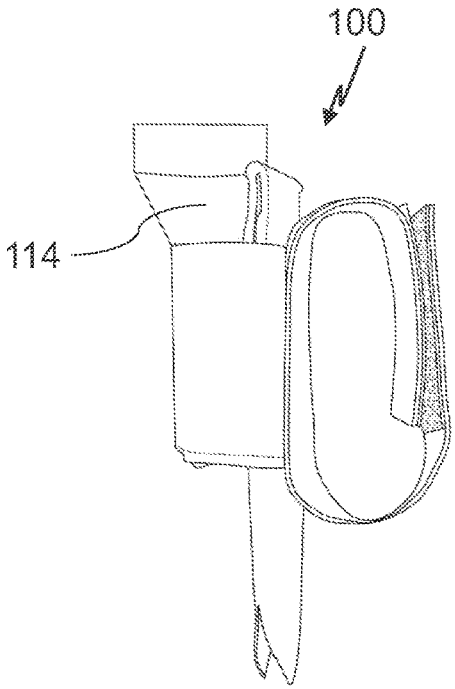
Figure 1C:
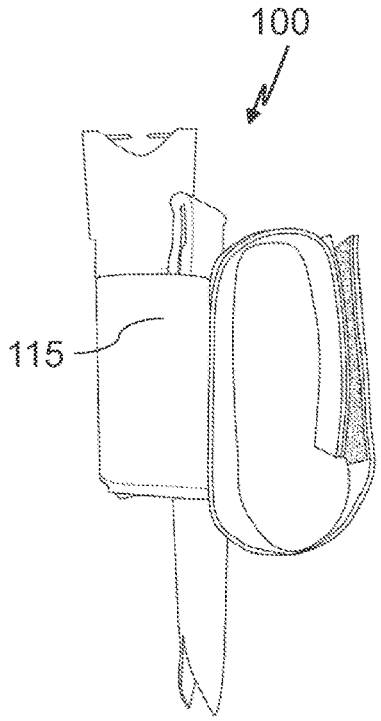
Figure 1D:
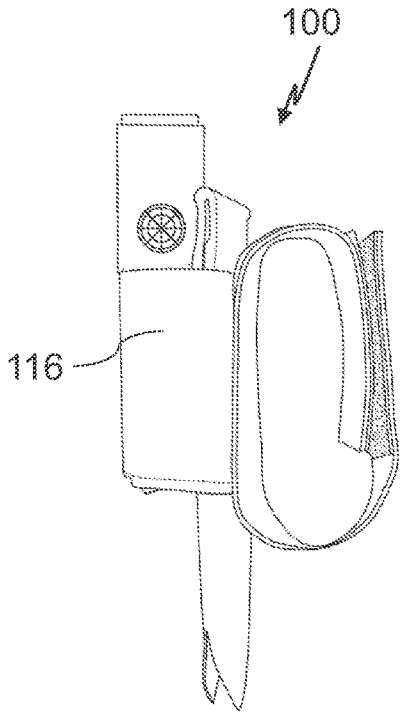

FIGS. 1B-1D show the self-defense system 100 with deterrent items 114, 115, 116. FIG. 1B shows a self-defense system 100 with a light deterrent item 114. FIG. 1C shows a self-defense system 100 with a stun device deterrent item 115. FIG. 1D shows a self-defense system 100 with a signaling alarm deterrent item 116. The deterrent items 114, 115, 116 may be as described relative to FIG. 1A, above. The deterrent items 114, 115, 116 shown herein are exemplary only.

Figure 2:
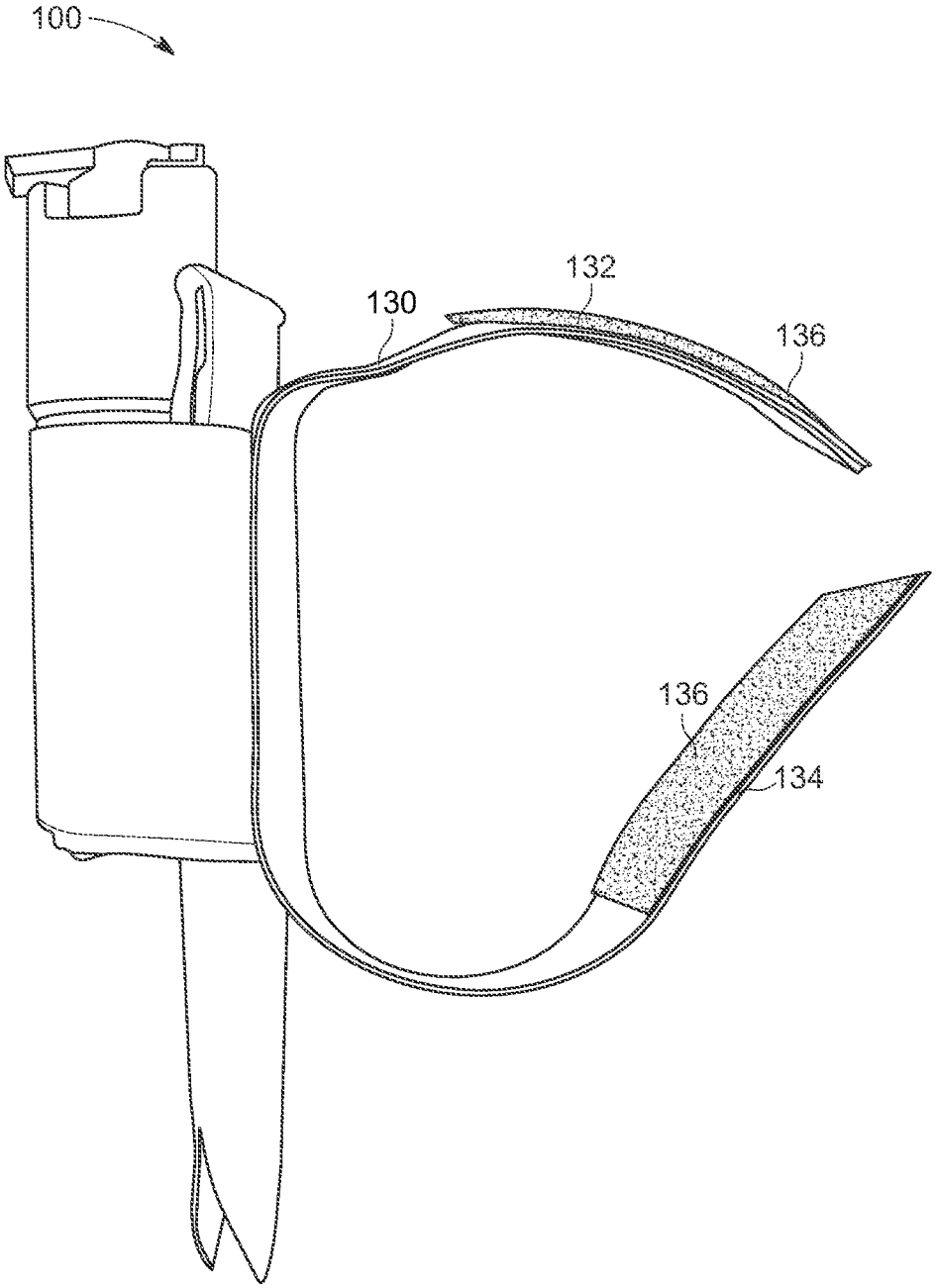
FIG. 2 is a side view illustration showing the removable strap ends of the self-defense system, in accordance with the first exemplary embodiment of the present disclosure.

FIG. 2 is a side view illustration showing the removable strap ends 132, 134 of the self-defense system 100, in accordance with the first exemplary embodiment of the present disclosure. In one example, the hand strap 130 may include a first end 132 and a second end 134. The first and second ends 132, 134 may be removably fastenable together. This may include any suitable fastening methods and materials, for instance, hook and loop fasteners 136, clasps, snaps, clips, magnets, buttons, wraps, pins, and the like. In one example, the first and second ends 132, 134 may be tied together. The user may remove the first and second ends 132, 134 from each other when putting on or taking off the hand strap 130. The user may fasten the first and second ends 132, 134 when putting on or storing the system 100. The removable first and second ends 132, 134 may fasten together along at least one location on the hand strap 130. For instance, the first and second ends 132, 134 may fasten along a plurality of locations, such as a plurality of buttons or hook and loop fastener surfaces. In another example, a hook and loop fastener material may extend along at least a portion of each first and second end 132, 134. The second end 134 may be attached to the first end 132 along any suitable position. This may allow the hand strap to be adjusted to fit any size hand or to provide a desired tightness when worn.

Figure 3:
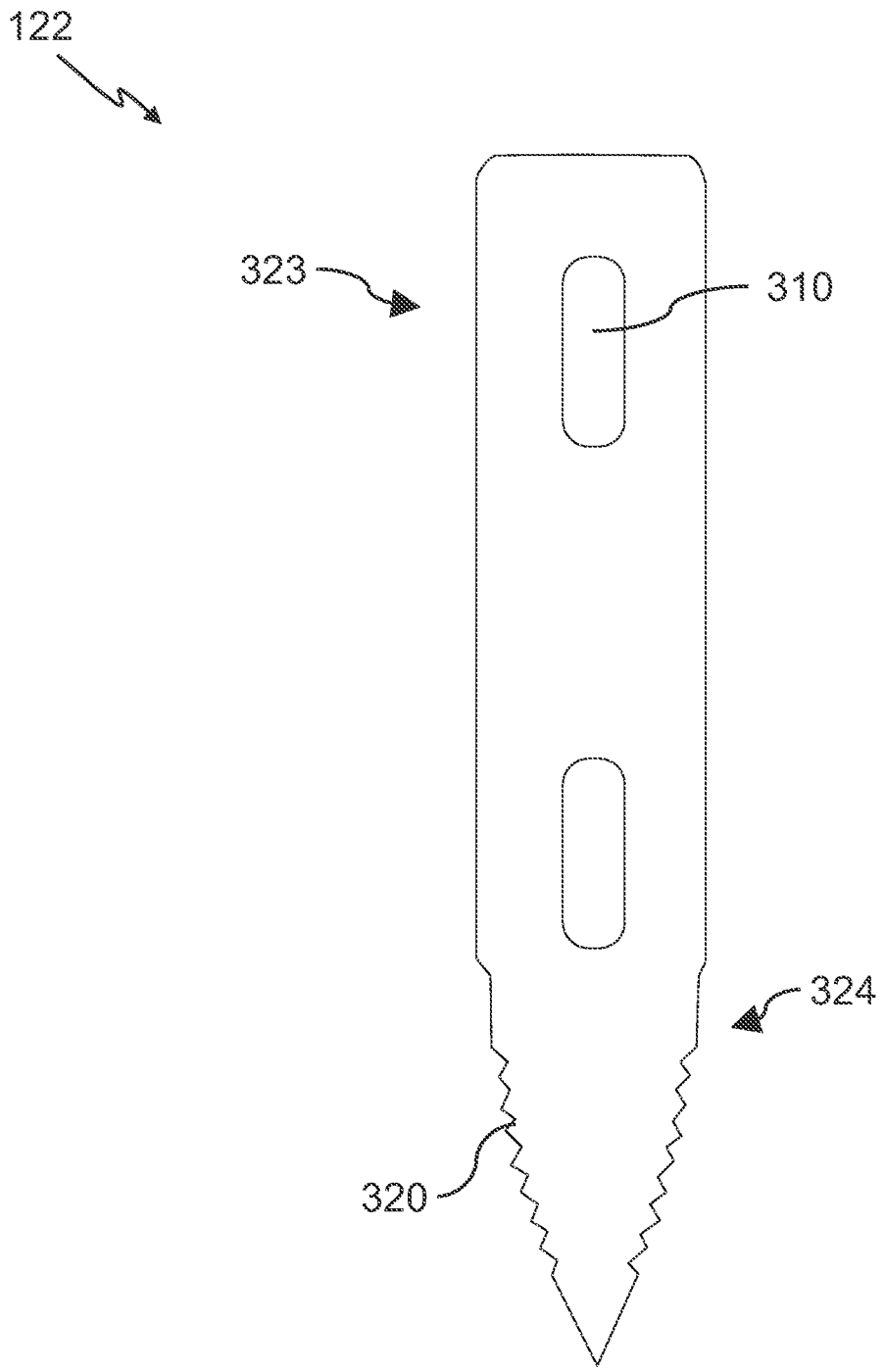
FIG. 3 is a diagrammatic illustration of the knife, in accordance with the first exemplary embodiment of the present disclosure.

FIG. 3 is a diagrammatic illustration of the knife 122, in accordance with the first exemplary embodiment of the present disclosure. The knife 122 may be made from any suitable material or combination of materials, including metal, alloy, plastic, polymer, wood, bone, ceramic, carbon fiber, glass, or any other hard or hardened materials. In one example, the knife may be made from a thermoplastic, such as a thermo-set type plastic. The knife 122 may include a handle 323 and a tip 324. The handle 323 may be sized along an elongate axis. In one example, the handle 323 may be sized to extend across a substantial portion of a user's hand along the elongate axis. This may allow the user to firmly grasp the knife 122 when using it to stab or poke. A handle 323 somewhat smaller than the user's hand may be more difficult to stabilize during use, while a handle 323 extending significantly below the user's hand may increase the likelihood of the user accidentally scraping or cutting an unwanted surface. The handle 323 may have a width orthogonal to the elongate axis. The width of the handle 323 may be substantially less than a width of the user's hand, which may allow the user to grasp it more firmly. It may be understood in light of FIGS. 1A and 3 that, in one example, the width of the handle 323 may be substantially the same as a width of the deterrent item 112. This may allow the user to firmly grasp both the deterrent item 112 and the knife 122 along their exterior edges, which may increase the firmness of the user's grasp in use. The handle 323 may have any suitable shape and thickness. In one example, the handle 323 may be substantially rectangular in shape with a flattened thickness. This may be understood in light of FIG. 1A. The flattened thickness may allow the user to grasp the deterrent item 112 and the knife 122 more firmly. In another example, the shape and thickness of the handle 323 may be partially rounded to conform to the deterrent item 112 or the interior of the user's hand.

The tip 324 of the knife 122 may have any suitable shape and thickness. In one example, the tip 324 may be made from the same material as the handle 323. In another example, the tip 324 and handle 323 may be formed as a unitary, monolithic piece. The tip 324 may generally have a flat thickness, as a blade, but may, in other examples, have a tapered, rounded thickness. The tip 324 may be sharpened as is known in the art, and may be sharp enough to pierce human or animal skin. In one example, the tip 324 may have a serrated edge 320 along at least a portion of the tip 324. The serrated edge 320 may damage tissue to a greater degree than a plain edge when removed from the tissue, which may improve the defense and deterrent effect of the system 100 when in use. Any other tip 324 shapes, configurations, and number of blades is contemplated within the scope of this disclosure. For example, barbs, hooks, gaffs, multiple blades, or any combination thereof may be employed. In one example, the tip 324 may not be straight along its entire length. For instance, it may be curved, wavy, tapered, squared, bulging, or any other regular or irregular geometric configuration. Likewise, the tip 324 may vary in thickness and/or width along its length.

It may be understood in light of FIGS. 1A and 3 that the knife 122 may extend below the deterrent item 112 when housed within the second sleeve 120. In particular, the tip 324 may extend below the deterrent item 112, and, thereby, the hand of the user, when in use. This may allow the user to effectively stab an attacker while the knife is in the second sleeve 120. In one particular example, the knife 122 may extend less than about 2 inches below the deterrent item 112.

In one example, the knife 122 may include one or more cutouts 310. The cutouts 310 may be positioned at any suitable location along the knife 122, for instance, along the handle 323. Referring to FIGS. 1A-3, the cutouts 310 may allow the knife 122 to be further secured within the second sleeve 120. For example, two sides of the second housing 120 may be sewn together through the cutouts 310. As another example, the knife 122 may be secured by rivets, pins, bolts, inserts, adhesive, and the like.

Figure 4:
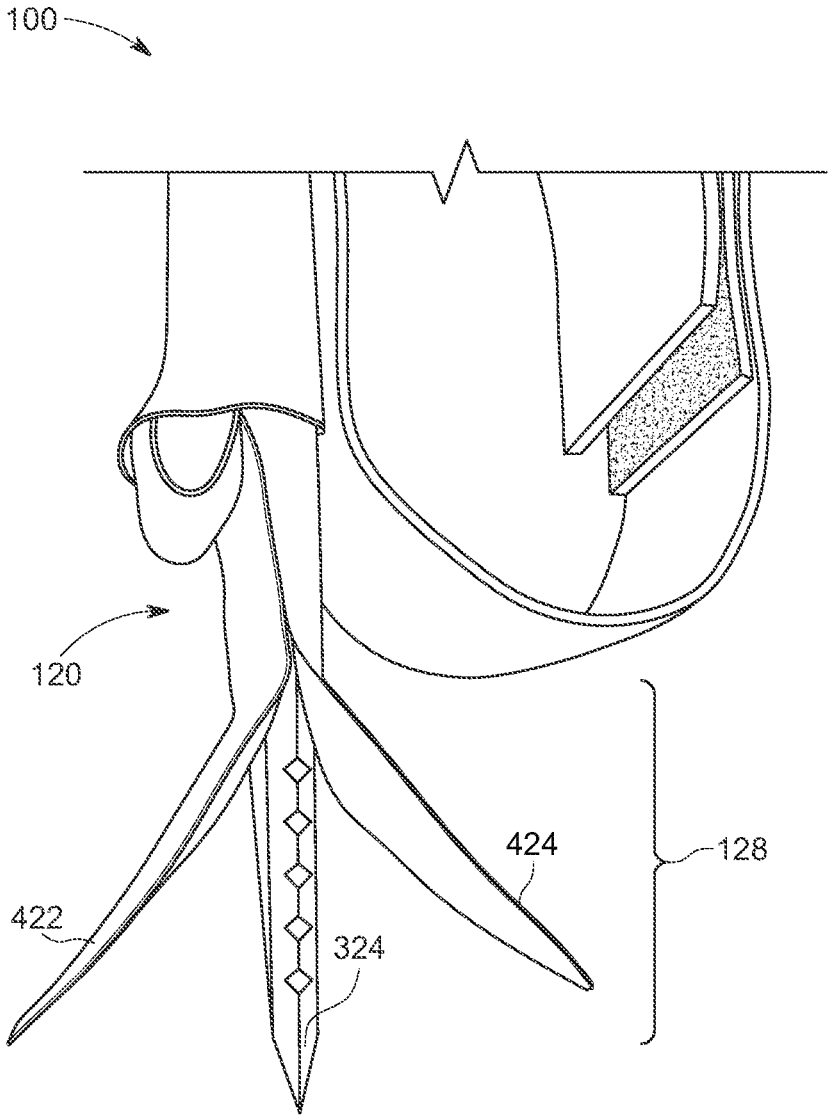
FIG. 4 is a close-up view of the knife tip within the second sleeve, in accordance with the first exemplary embodiment of the present disclosure.

FIG. 4 is a close-up view of the knife tip 324 within the second sleeve 120, in accordance with the first exemplary embodiment of the present disclosure. As described relative to FIGS. 1A-3, above, the knife tip 324 may be at least partially covered by the open portion 128 of the second sleeve 120. The open portion 128 may be open along at least a portion of the outer edge of the second sleeve 120, allowing the open portion 128 to flex away from the knife tip 324. In one example, the open portion 128 may include first and second sides 422, 424 of the second sleeve 120. The first and second sides 422, 424 may be shaped to generally match the shape of the knife tip 324 in order to provide exterior cover to the knife tip 324. The first and second sides 422, 424 may not be connected to one another around at least a portion of the knife tip 324, allowing the knife tip 324 to be exposed when the sides 422, 424 are peeled, pushed, or pulled back. When in use, the first and second sides 422, 424 may be biasable to expose at least a portion of the knife tip 324. That is, a force upon the first and second sides 422, 424 may push them away from the point of the knife tip 324 and, therefore, the edge of the blade. This may move the open portion 128 from an initial covering position into a secondary revealing position.

When in a covering position, the open portion 128 may provide protection to the user of the system 100 against accidental or incidental contact. The open portion 128 may buffer any unintended contact between the knife tip 324 and another surface. When in a revealing position, the open portion 128 may allow the knife 122 to be used quickly and effectively, as the sharp portions of the knife tip 324 may be exposed. The first and second sides 422, 424 may return to the initial covering position after the tip 324 has been removed from the target. It should be understood that the open portion 128 may flex between the covering and revealing positions using any number, configuration, and size of sides of the second sleeve 120. The first and second sides 422, 424 are discussed as examples only.

Figure 5:
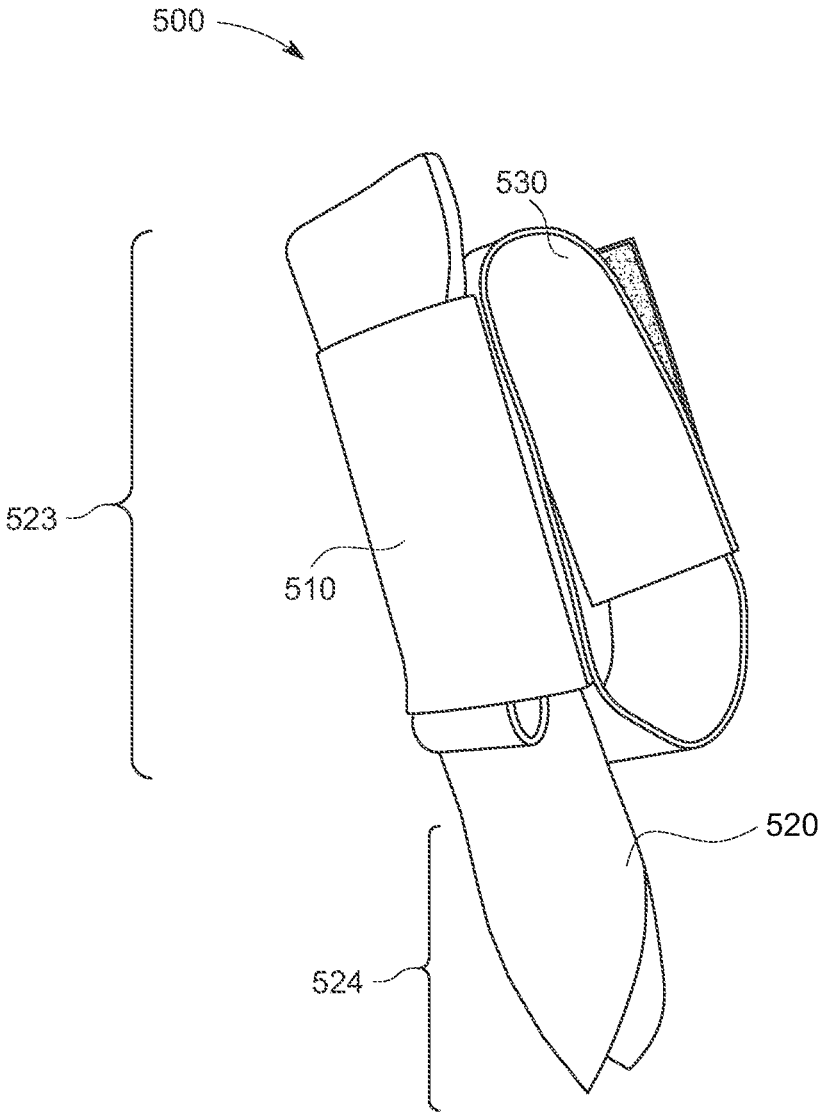
FIG. 5 is an isometric illustration of a self-defense device holder, in accordance with the first exemplary embodiment of the present disclosure.

FIG. 5 is an isometric illustration of a self-defense device holder 500, in accordance with the first exemplary embodiment. The self-defense device holder 500 includes a first sleeve 510 sized and shaped to retainably secure a deterrent item. A second sleeve 520 is laterally coupled to the first sleeve 510. The second sleeve 520 has a closed portion 523 and an open portion 524. The closed portion 523 is sized and shaped to house at least a portion of a knife handle. The open portion 524 is shaped to flexibly cover a knife tip. A hand strap 530 is laterally adjacent to the second sleeve 520 and coupled to at least one of: the first sleeve 510 and the second sleeve 520. The hand strap 530 is sized and shaped to secure the self-defense device holder 500 about a hand of a user.

The first sleeve 510, second sleeve 520, and hand strap 530 may be understood with reference to FIGS. 1A-4, above. They may be the same component elements, sized and shaped in the same way, formed from the same materials, and arranged in the same manner. The deterrent item and knife housable within the self-defense device holder 500 may be the same components as described above.

Figure 6:
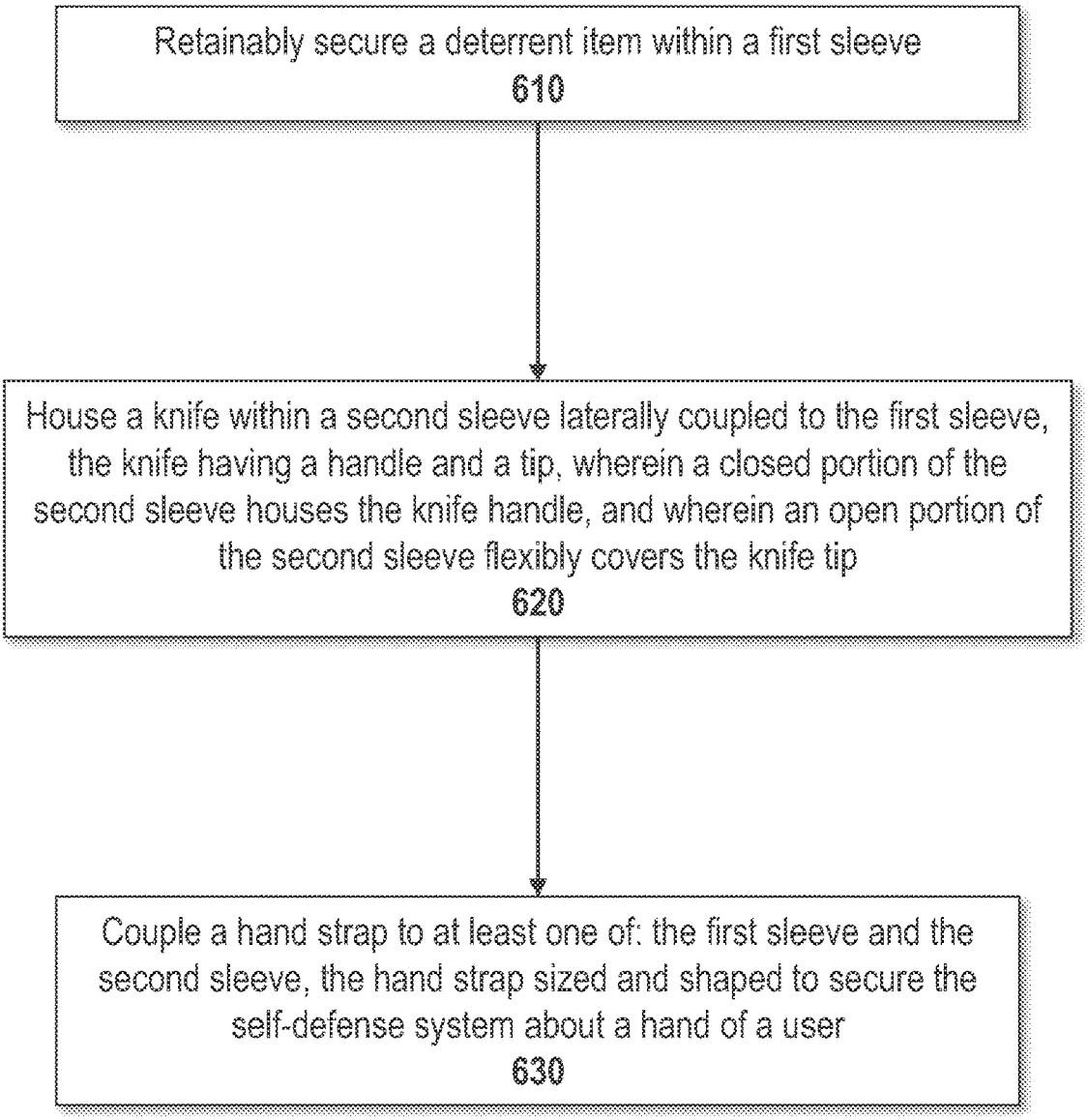
FIG. 6 is a flowchart illustrating a method of making a self-defense system, in accordance with the first exemplary embodiment of the present disclosure.

FIG. 6 is a flowchart 600 illustrating a method of making a self-defense system, in accordance with the first exemplary embodiment of the present disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

Step 610 involves retainably securing a deterrent item within a first sleeve. The deterrent item may be any of the deterrent items described relative to FIGS. 1A-1D, above. The first sleeve may be as described relative to the same figures. In one example, the first sleeve may be made from an expandable material, and may be formed by wrapping the expandable material to form a horizontal side wall and a bottom side wall. In one particular example, a strip of expandable material may be wrapped so that first and second ends of the strip are joined together to form the horizontal side wall. An additional strip of expandable material may be affixed at a bottom portion of the horizontal side wall to form the bottom side wall. The strips may be joined and affixed by any suitable methods, including by sewing together. In one example, the bottom side wall strip may be sewn to the interior of the horizontal side wall strip.

The deterrent item may be placed within the first sleeve until it is securely held. Where the first sleeve is made from strips of expandable material, the first sleeve may be expanded and the deterrent item placed therein. The elastic nature of the expandable material may securely retain the deterrent item.

Step 620 involves housing a knife within a second sleeve laterally coupled to the first sleeve, the knife having a handle and a tip, wherein a closed portion of the second sleeve houses the knife handle, and wherein an open portion of the second sleeve flexibly covers the knife tip.

The knife and the second sleeve may be as described above relative to FIGS. 1A-1D. In one example, the second sleeve may be made from a woven material such as a natural or synthetic fabric. A strip of woven material measuring about twice the length of the knife may be folded in half. The open portion of the second sleeve may be located where first and second ends of the woven strip meet. The first and second ends of the woven strip may be cut to generally match the shape of the knife tip. The knife may be placed between the interior of the woven strip, with a top end of the knife handle positioned against the fold. In one example, the knife may be secured within the second sleeve by any suitable method, for instance, by sewing the knife into the second sleeve. The lengthwise edges of the woven strip may be sewn along the knife handle to create the closed portion, and the sides of the woven strip may be sewn together where cutout portions of the knife allow. The open portion may be left open to allow the second sleeve to flexibly cover the knife tip.

The second sleeve may be laterally coupled to the first sleeve. In one example, the second sleeve may be placed within the first sleeve and fastened to the interior side of the first sleeve. Where the first sleeve is made from strips of flexible material, the bottom side wall strip may be fastened to the second sleeve instead of a horizontal side wall of the first sleeve. This may allow the second sleeve and knife to create a sturdy side wall surface against which the deterrent item may rest when in use.

Step 630 involves coupling a hand strap to at least one of: the first sleeve and the second sleeve, the hand strap sized and shaped to secure the self-defense device about a hand of a user. In one example, the hand strap may be made from an expandable material. A strip of the expandable material may be cut having a length at least twice the length of a user's hand. The strip of expandable material may be joined to form a loop. In one example, the strip of expandable material may have first and second ends. In another example, the first and second ends may include a hook and loop fastener for connecting the first and second ends together. A portion of the strip of expandable material may be fastened to the first and/or second sleeves using any suitable methods, for instance, by sewing the strip to one or more locations on the first or second sleeves.

It should be noted that the method may be performed using any of the suitable materials and components described relative to FIGS. 1A-5, above. The method may further include any other features, components, or functions disclosed relative to any other figure of this disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A self-defense system, comprising:

a deterrent item consisting of at least one from the set of: pepper spray, a light, a stun device, and a signaling alarm;

a first sleeve retainably securing the deterrent item;

a knife having a handle and a tip;

a second sleeve laterally coupled to the first sleeve and housing the knife, the second sleeve comprising a first side and a second side joined together along a portion of a perimeter of the second sleeve, wherein a joined portion of the second sleeve houses the knife handle, wherein an unjoined portion of the second sleeve is movable between an initial covering position and a secondary revealing position, wherein in the initial covering position, the knife tip is covered by the first and second sides, and wherein in the secondary revealing position, the first and second sides move away from the knife tip to expose the knife tip; and a hand strap laterally adjacent to the second sleeve and coupled to at least one of: the first sleeve and the second sleeve, the hand strap sized and shaped to secure the self-defense system about a hand of a user.

2. The self-defense system of claim 1, wherein the first sleeve comprises at least one horizontal sidewall, and wherein the at least one horizontal sidewall is elastically expandable to retainably secure the deterrent item.

3. The self-defense system of claim 1, wherein the deterrent item is a canister of pepper spray, and wherein a nozzle of the canister extends above the first sleeve.

4. The self-defense system of claim 1, wherein the hand strap comprises first and second strap ends removably fastenable together.

5. The self-defense system of claim 4, wherein the first and second strap ends comprise a hook and loop fastener.

6. The self-defense system of claim 1, wherein the unjoined portion is flexible away from the knife tip to expose at least a portion of the knife tip.

7. The self-defense system of claim 1, wherein the knife tip is sized to extend below the user's hand.

8. The self-defense system of claim 1, wherein the knife tip is below the deterrent item.

9. A self-defense device holder, comprising:

a first sleeve;

a second sleeve laterally coupled to the first sleeve, the second sleeve comprising a first side and a second side joined together along a portion of a perimeter of the second sleeve, wherein an unjoined portion of the second sleeve is movable between an initial covering position and a secondary revealing position, wherein in the initial covering position, the first and second sides are near one another, and wherein in the secondary revealing position, the first and second sides move outwardly away from one another; and a hand strap laterally adjacent to the second sleeve and coupled to at least one of: the first sleeve and the second sleeve, the hand strap sized and shaped to secure the self-defense device holder about a hand of a user.

10. The self-defense device holder of claim 9, wherein the first sleeve comprises at least one horizontal sidewall, and wherein the at least one horizontal sidewall is elastically expandable.

11. The self-defense device holder of claim 9, wherein the hand strap comprises first and second strap ends removably fastenable together.

12. The self-defense device holder of claim 11, wherein the first and second strap ends comprise a hook and loop fastener.

13. The self-defense device holder of claim 9, wherein the unjoined portion is flexible away from a central plane between the first and second sides.

14. The self-defense device holder of claim 9, wherein the joined portion is sized to extend fully across the user's hand.

15. The self-defense device holder of claim 9, wherein the unjoined portion is below the first sleeve.

16. A method of making a self-defense system, comprising the following steps:

retainably securing a deterrent item within a first sleeve, wherein the deterrent item consists of at least one from the set of: pepper spray, a light, a stun device, and a signaling alarm;

housing a knife within a second sleeve laterally coupled to the first sleeve, the knife having a handle and a tip, and the second sleeve comprising a first side and a second side joined together along a portion of a perimeter of the second sleeve, wherein a joined portion of the second sleeve houses the knife handle, and wherein an unjoined portion of the second sleeve is movable between an initial covering position and a secondary revealing position, wherein in the initial covering position, the knife tip is covered by the first and second sides, and wherein in the secondary revealing position, the first and second sides move away from the knife tip to expose the knife tip; and coupling a hand strap to at least one of: the first sleeve and the second sleeve, the hand strap sized and shaped to secure the self-defense system about a hand of a user.

17. The method of claim 16, wherein the first sleeve comprises at least one horizontal sidewall, and wherein the at least one horizontal sidewall is elastically expandable to retainably secure the deterrent item.

18. The method of claim 16, wherein the hand strap comprises first and second strap ends removably fastenable together.

19. The method of claim 18, wherein the first and second strap ends comprise a hook and loop fastener.

* * * * *